US007263810B1

(12) United States Patent
Trauba

(10) Patent No.: US 7,263,810 B1
(45) Date of Patent: Sep. 4, 2007

(54) METHOD FOR INSTALLING INSULATION

(76) Inventor: Todd Trauba, 14677 Rummingbird St. NW., Andover, MN (US) 55304

( * ) Notice: Subject to any disclaimer, the term of this patent is extended or adjusted under 35 U.S.C. 154(b) by 595 days.

(21) Appl. No.: 10/794,820

(22) Filed: Mar. 8, 2004

(51) Int. Cl.
*E04B 1/00* (2006.01)

(52) U.S. Cl. ..... 52/742.13; 52/404.1

(58) Field of Classification Search ..... 52/404.1, 52/742.13

See application file for complete search history.

(56) References Cited

U.S. PATENT DOCUMENTS 4,177,618 A * 12/1979 Felter ..... 52/742.13
4,385,477 A * 5/1983 Walls et al. ..... 52/742.13
4,712,347 A * 12/1987 Sperber ..... 52/404.1
5,365,716 A * 11/1994 Munson ..... 52/742.13
5,655,350 A * 8/1997 Patton ..... 52/742.13
5,697,198 A * 12/1997 Ponder et al. ..... 52/742.13
5,819,496 A * 10/1998 Sperber ..... 52/742.13
6,550,212 B2 * 4/2003 Lubker, II ..... 52/741.13

* cited by examiner

*Primary Examiner*—Joe Dillon, Jr.
(74) *Attorney, Agent, or Firm*—Thomas B. Tate

(57) ABSTRACT

A method for installing insulation into the wall cavities of a building is disclosed. The method includes the following steps: hanging a sheet of polymeric material against the wall, cutting and mounting tracks around the studs, drilling holes into the tracks and inserting screws to pull the polymeric material tight, cutting an opening into the sheet and inserting a tube, blowing insulation into the cavity until it is filled, and removing the tracks.

1 Claim, 2 Drawing Sheets

METHOD FOR INSTALLING INSULATION

BACKGROUND OF THE INVENTION

The field of the invention is methods for installing insulation into a building.

A common conventional method is to install a batt of fiberglass insulation into each wall cavity and then to attach a sheet of polymeric plastic material (commonly called "poly") to the studs as a vapor barrier. This method is time-consuming and labor-intensive.

Another common conventional method is to wet-spray cellulose insulation into the wall cavities. This method is expensive, requires cleanup by shaving excess cellulose off of the studs, and does not work well in cold weather due to lengthy drying time.

Blowing dry cellulose insulation into the wall cavities through a hose or tube is usually done in remodeling rather than new construction, by drilling a hole through the sheetrock and running the tube down along the sidewall. Use of this method in new construction has been limited because of the difficulty in holding the sheet of poly tight enough to prevent the insulation from settling during or shortly after installation.

The closest known prior art is a blown insulation method used by Parpac, West Swazey, N.H., and described in U.S. Pat. No. 5,365,716 to Munson. In that system, the poly is stapled to the studs rather than being held in position by removable tracks as in the present invention.

SUMMARY OF THE INVENTION

The following method is used in the present invention. A sheet of poly is hung along the wall, tracks are cut to fit and are applied to each stud to hold the poly in position, holes are drilled into the tracks and screws are inserted to pull the poly very tight, an opening is cut into the poly and insulation is blown through a tube into the wall cavity through the opening. When the cavity is completely full of insulation, the tube is removed and the opening is sealed, and the tracks are removed. Sheetrock can then be placed over the poly to form the inner wall.

An advantage of the invention is that insulation can be packed more densely (about three and one-half to four pounds per wall cavity) than with prior art methods, thus increasing the R-value of the insulation to R-24 as compared to R-19 with conventional batts. The insulation can also be packed more densely than with prior art blown insulation methods and without mechanically ramming the blown insulation into the wall cavity, because the poly does not bow outward but stays tight.

Another advantage of the invention is that the insulation can be inspected with the poly on, before the sheetrock is installed.

Another advantage of the invention is that the sheetrock can be laid smoothly over the poly because there are no staples and no tracks left in position on the studs.

Another advantage of the invention is that the tracks are re-usable, thus saving money, time, and effort.

DETAILED DESCRIPTION OF THE INVENTION

Figure 1:
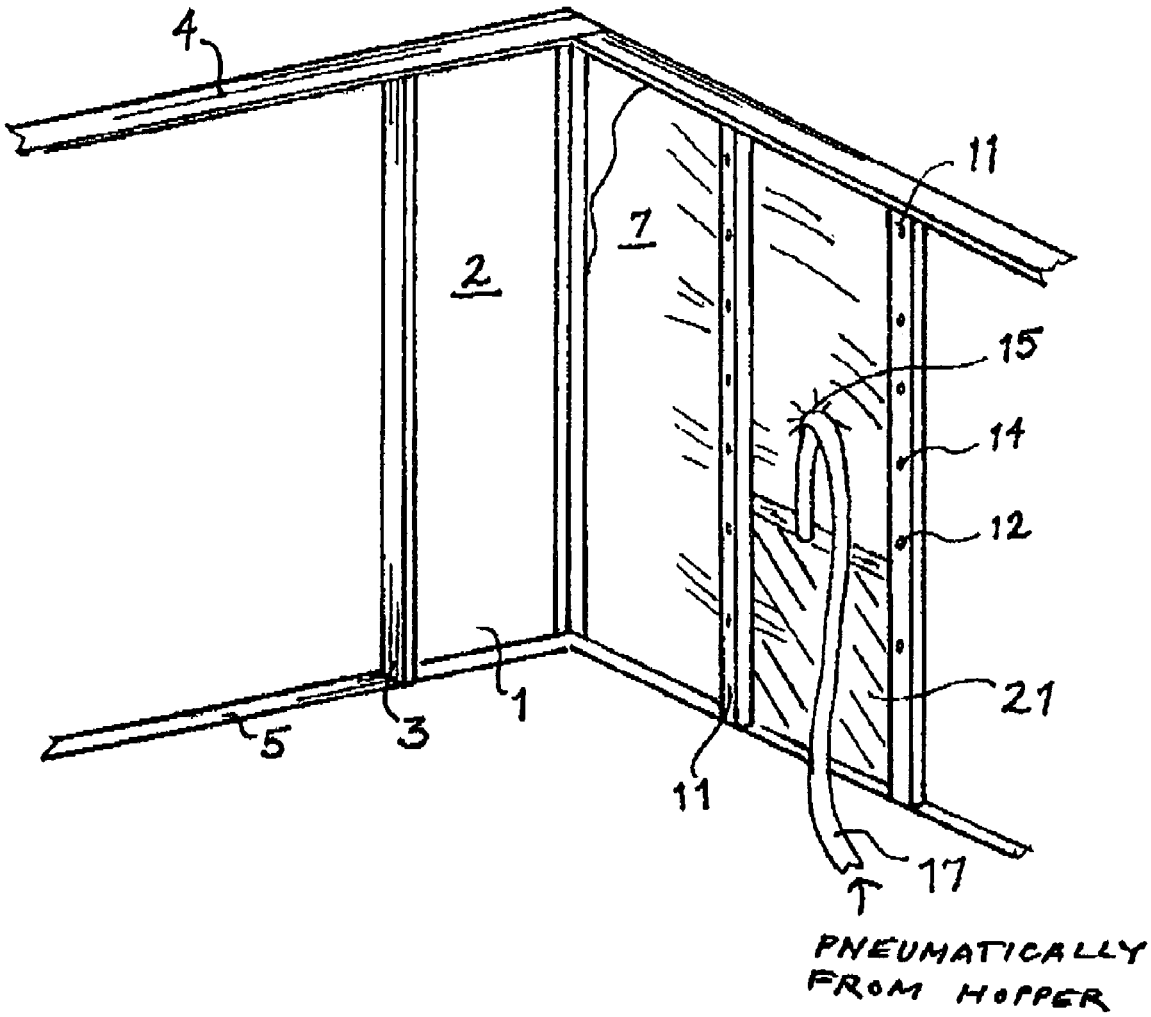
FIG. 1 is a perspective view showing the method of the invention.
Figure 2:
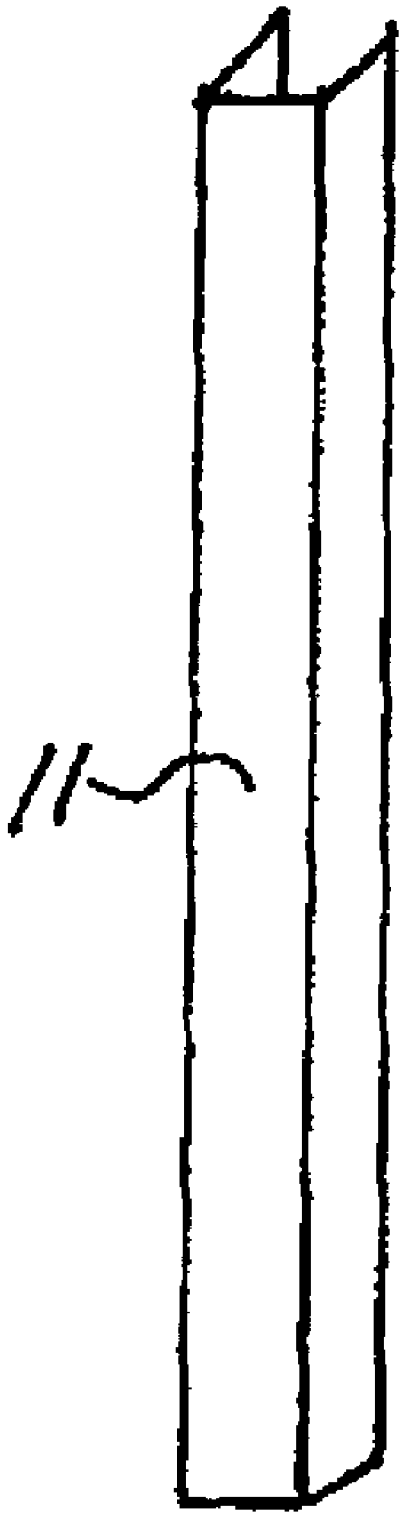
FIG. 2 is a front perspective view of one of the trucks use in the method of the invention.

Insulation is installed at the stage of construction when the building has been framed and the outer walls have been constructed so that a plurality of wall cavities 1 are each defined by the outer wall 2, adjacent parallel vertical studs 3, a horizontal top plate 4, and a horizontal bottom plate 5.

The first step in my new installation method is hanging a sheet 7 of minimal stretch reinforced polymeric plastic material against the walls and attaching the sheet 7 to the top plate 4 and the bottom plate 5, by stapling the sheet 7 to the top plate 4 and the bottom plate 5 using a conventional hammer staple gun. Usually one large sheet 7 of poly is used for all four walls of a room in a building. The poly is preferably polystyrene, but polyethylene or other suitable polymeric plastic materials may be used. If the wall is to remain uncovered, the poly should be fire-retardant, but if the wall is to be covered with sheetrock, the poly need not be fire-retardant. A brand of poly that has been found to work well is DURA SKRIM, manufactured by Raven Industries, Inc., Sioux Falls, S. Dak.

The next step is cutting a plurality of tracks 11 to size in order to fit around the studs 3 between the top plate 4 and the bottom plate 5, and then mounting one of the tracks 11 onto each of the studs 3. Furring channels (which are commonly used for sheetrock installation) are well-suited for use as the tracks 11, but other suitable structures may be used. An example of the type of furring channel which can be used is one and one-half inch DWC-wide hat twenty gauge furring channel manufactured by Phillips Manufacturing Co. The length to which the tracks 11 are cut usually will be eight to ten feet, which is typical wall height. When each track 11 is said to be mounted to fit around each stud 3, that means that the track 11 completely covers the front surface and at least mostly covers the side surfaces of the stud 3.

The next step is drilling holes 12 into the front surface of each track 11 at generally regular intervals, optimally about sixteen inches apart, and inserting a screw 14 into each hole 12 using a conventional screw gun. The insertion of the screws 14 into the tracks 11 causes the sheet 7 of poly to be pulled extremely tight. The tightness of the poly is the key to my method, as it allows for blowing insulation at high density.

The next step is cutting an opening 15 into the sheet 7 of poly using a conventional utility knife, then inserting an insulation tube or hose 17 into the wall cavity 1 through the opening 15, then blowing insulation 21 from a conventional hopper through the tube 17 into a wall cavity 1 until the cavity 1 is completely filled and therefore densely packed, then withdrawing the tube 17 and sealing the opening 15 by any suitable conventional method. The preferred type of insulation 21 used is cellulose. Class 1A cellulose is recommended for a high-quality professional job, but lower grades of cellulose or other suitable materials may be used. This step is repeated until each wall cavity 1 has been filled with insulation 21.

The final step is extracting the screws 14 and removing the tracks 11 from the sheet 7 of poly and the studs 3. Sheetrock can then be laid over the poly 7 in a conventional manner to form the inner wall. In addition to allowing sheetrock to be laid more smoothly without the tracks 11 present, removal of the tracks 11 before installing the sheetrock allows the tracks 11 to be re-used for future insulation jobs.

I claim:

1. A method for installing insulation into cavities formed into a wall of a building, each of said wall cavities being defined by an exterior wall, vertical studs having an outward surface, a horizontal top plate, and a horizontal bottom plate, said method comprising the following steps;

(a) hanging a sheet of minimal stretch reinforced polymeric plastic material against said studs and attaching said sheet to said top plate and said bottom plate;

(b) cutting a plurality of tracks to fit onto and around said outward surface of said studs between said top plate and said bottom plate, and mounting one of said tracks onto and around said outward surface of each of said studs;

(c) drilling holes into said tracks at generally regular intervals and inserting screws into said holes and through said sheet of polymeric plastic material using a screw gun to pull said sheet of polymeric plastic material tight, (d) cutting an opening into said sheet of polymeric plastic material and inserting an insulation tube therethrough, and blowing dense pack insulation through said tube into said wall cavity until said cavity is completely filled, then withdrawing said tube and sealing said opening;

(e) removing said tracks so that said tracks can be re-used;

wherein when re-using said tracks, said tracks have already been cut as in step (b) and drilled as in step (c); therefore in the second and subsequent uses of a track, step (b) is modified to be: mounting a track onto and around said outward surface of each of said studs; and step (c) is modified to be: inserting screws into holes in said tracks and through said sheet of polymeric plastic material using a screw gun to pull said sheet of polymeric plastic material tight; steps (a), (d), and (e) remaining the same as recited above.

* * * * *